US006874878B2

(12) United States Patent
Sugata

(10) Patent No.: US 6,874,878 B2
(45) Date of Patent: Apr. 5, 2005

(54) SUPPLY LIQUID CARTRIDGE, AND IMAGE FORMING APPARATUS HAVING THE SUPPLY LIQUID CARTRIDGE

(75) Inventor: Yoshihisa Sugata, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 49 days.

(21) Appl. No.: 10/351,580

(22) Filed: Jan. 27, 2003

(65) Prior Publication Data

US 2003/0142181 A1 Jul. 31, 2003

(30) Foreign Application Priority Data

Jan. 29, 2002 (JP) ..... 2002-020060

(51) Int. Cl.[7] ..... B41J 2/175
(52) U.S. Cl. ..... 347/86
(58) Field of Search ..... 347/84, 85, 86, 347/87; 401/145; 429/139; 222/92, 105; 206/593, 524.8

(56) References Cited

U.S. PATENT DOCUMENTS 3,703,417 A * 11/1972 Rosa et al. ..... 429/139
5,537,134 A * 7/1996 Baldwin et al. ..... 347/85
5,975,689 A * 11/1999 Pawlowski et al. ..... 347/86
6,106,180 A * 8/2000 Anderka ..... 401/145
6,151,052 A * 11/2000 Yang et al. ..... 347/87
6,220,702 B1 * 4/2001 Nakamura et al. ..... 347/86
6,609,789 B1 * 8/2003 Hunt ..... 347/86

* cited by examiner

*Primary Examiner*—Anh T. N. Vo
(74) *Attorney, Agent, or Firm*—Smith Patent Office

(57) ABSTRACT

An ink jet printer of the invention is comprised of: an ink cartridge including an ink pack enclosing an ink and an air injection pack arranged adjacent to the ink pack; and an air feed unit for feeding the air to the inside of the air injection pack on the basis of the control of a controller. When the air is injected from the air feed unit into the air injection pack, the volume of the ink pack is decreased so that the ink is discharged from the ink pack, as the volume of the air injection pack is increased. And, the ink, as discharged from the ink pack, is fed to a printing head so that it is discharged to a paper.

9 Claims, 7 Drawing Sheets

SUPPLY LIQUID CARTRIDGE, AND IMAGE FORMING APPARATUS HAVING THE SUPPLY LIQUID CARTRIDGE

BACKGROUND OF THE INVENTION

1. Field of the Invention

The present invention relates to a supply liquid cartridge for reserving a supply liquid, and an image forming apparatus having the supply liquid cartridge.

2. Description of the Related Art

An ink jet printer for printing by injecting a liquid ink to a paper is provided with a printing head arranged to confront the paper, and an ink cartridge for reserving the ink to be used for the printing is generally made removable. In this printer, the ink reserved in the ink cartridge is suitably fed to the printing head and is discharged from the printing head to the paper so that an image is printed.

Here, some ink cartridge includes an ink pack enclosing the ink and a case for housing the ink pack. In a known large-sized ink jet printer, moreover, the ink in the ink pack is forcedly fed to the printing head by feeding compressed air to the inside of the case of the ink cartridge thereby to pressurize the air in that case. Therefore, the case of the ink cartridge to be used in such printer has to be gas-tight.

In order to make the case of the ink cartridge gas-tight, however, the steps of assembling the case are complicated, and a step of testing the gas-tightness has to be added after the assembly of the case is completed. Therefore, the cost for manufacturing the ink cartridge and the ink jet printer seriously rises. On the other hand, it is not easy to replace the ink pack which is housed in the gas-tight case. In case the used ink pack is taken out by once opening the case so that it may be replaced, moreover, the case has to be returned to the gas-tight state after it was housed in the case. Therefore, it takes serious troubles to use (or recycle) the case.

SUMMARY OF THE INVENTION

A primary object of the invention is to provide a supply liquid cartridge, which can lower its manufacture cost and can be easily recycled, and an image forming apparatus having the supply liquid cartridge.

According to a first aspect of the invention, there is provided a supply liquid cartridge comprising: an enclosing member enclosing a supply liquid; and a pressure member arranged adjacent to said enclosing member and enabled to decrease the volume of said enclosing member, as its volume is increased by a pressure medium fed to its inside.

According to this aspect, the pressure member is arranged adjacent to the enclosing member enclosing the supply liquid, and the volume of the enclosing member can be decreased to discharge the supply liquid from the inside of the enclosing member by feeding the pressure medium to the inside of the pressure member to increase the volume of the pressure member. Therefore, it is not always necessary to use the case which is made gas-tight for housing the enclosing member. Therefore, the steps of assembling the supply liquid cartridge can be suppressed from becoming complex, and the step of testing the gas-tightness of the case so that the cost for manufacturing the supply liquid cartridge can be lowered. Moreover, the used enclosing member can be easily replaced by an unused one so that the supply liquid cartridge can be easily recycled.

In the supply liquid cartridge of the invention, moreover, at least a portion of said enclosing member may be shared with said pressure member. According to this, the supply liquid confined in the enclosing member can be efficiently discharged. Moreover, it is possible to lower the cost for manufacturing the supply liquid cartridge (especially the cost for the material).

Moreover, the supply liquid cartridge of the invention may further comprise a case for housing said enclosing member and said pressure member. According to this, the enclosing member and the pressure member can be prevented from being broken while being carried, for example. Here, the case needs not have the gas-tightness so that its manufacturing step can be simplified.

Moreover, the supply liquid cartridge of the invention may further comprises a regulating member disposed around said enclosing member for regulating the fluctuation in the volume of said enclosing member. According to this, the supply liquid, as confined in the enclosing member, is efficiently discharged. Moreover, the enclosing member can be suppressed from being broken while being carried, for example.

In the supply liquid cartridge of the invention, moreover, said enclosing member and said pressure member may have substantially identical shapes. According to this, the supply liquid, as confined in the enclosing member, is efficiently discharged. Moreover, the member of the identical shape can be utilized for either the enclosing member for enclosing the supply liquid or the pressure member to be fed with the pressure medium, so that the enclosing member and the pressure member need not be separately manufactured.

In the supply liquid cartridge of the invention, moreover, both said enclosing member and said pressure member may have column shapes and may be so arranged adjacent to each other that their one-side faces confront each other. In the supply liquid cartridge of the invention, still moreover, said pressure member may be housed in said enclosing member. According to this, the supply liquid, as confined in the enclosing member, is efficiently discharged.

According to a second aspect of the invention, there is provided an image forming apparatus comprising: a supply liquid cartridge comprising an enclosing member enclosing a supply liquid and a pressure member arranged adjacent to said enclosing member and enabled to decrease the volume of said enclosing member, as its volume is increased by a pressure medium fed to its inside; a pressure medium feed device capable of feeding the pressure medium to the inside of said pressure member; a control device for controlling the quantity of the pressure medium to be fed from said pressure medium feed device to the inside of said pressure member; and a discharge unit for discharging the supply liquid, as discharged from said enclosing member, to a recording medium.

In the supply liquid cartridge, according to this, the pressure medium is fed from the pressure medium feed device to the inside of the pressure member, which is arranged adjacent to the enclosing member enclosing the supply liquid, to increase the volume of the pressure member so that the volume of the enclosing member can be decreased to discharge the supply liquid from the inside of the enclosing member. Moreover, the supply liquid, as discharged from the inside of the enclosing member, is fed to the discharge unit and discharged to the recording medium. Therefore, the image forming apparatus needs not always use the supply liquid cartridge which includes the case having the gas-tightness for confining the enclosing member. Therefore, the steps of assembling the supply liquid cartridge can be suppressed from becoming complex, and the step of testing the gas-tightness of the case needs not be added to lower the cost for manufacturing the supply liquid cartridge. As a result, the steps of manufacturing the image forming apparatus are simplified, and the cost for manufacturing the image forming apparatus is lowered.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
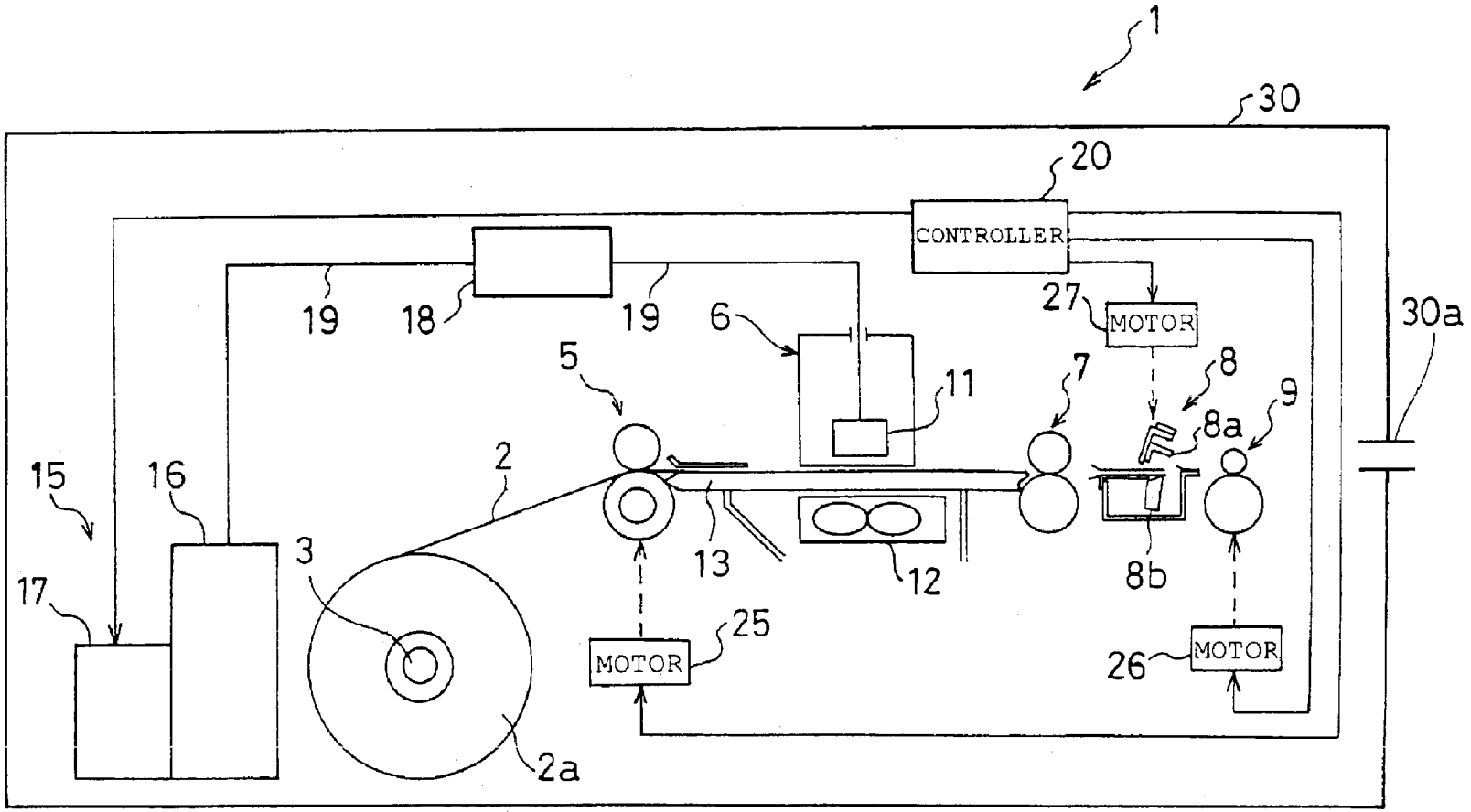
FIG. 1 is a diagram showing the schematic construction of an ink jet printer including an ink cartridge according to the first embodiment of the invention.

A preferred embodiment of this invention will be described with reference to the accompanying drawings. FIG. 1 is a diagram showing the schematic construction of an ink jet printer including an ink cartridge according to the first embodiment of the invention.

An ink jet printer 1, as shown in FIG. 1, includes a conveyor roller unit 5, an ink jet printing unit 6, a pressure roller unit 7, a cutting unit 8, a discharge roller unit 9 and an ink feed unit 15 in a generally rectangular parallelepiped case 30. In this case 30, there is arranged a lengthy paper 2, which is wound in a roll shape to have a wound portion 2*a*. This wound portion 2*a* of the paper 2 is held on a drum 3, which can be rotated on an axis. Moreover, as described later, the actions of the individual portions of the ink jet printer 1 are controlled by a controller 20 arranged in the case 30.

The conveyor roller unit 5 is composed of a pair of drive rollers, which is driven by a motor 25 controlled by the controller 20, and unrolls the paper 2 from the wound portion 2*a* and feeds it to the ink jet printing unit 6. Specifically, the conveyor roller unit 5 unrolls the paper 2 from the wound portion 2*a* and conveys it downstream so that the paper 2 may pass through the ink jet printing unit 6 and the cutting unit 8 sequentially.

The ink jet printing unit 6 includes a printing head 11, an adsorption fan 12 and a carriage or carrying table 13. The printing head 11 is provided with a number of (not-shown) discharge nozzles, which can discharge color inks of yellow (yellow), magenta (reddish purple), cyan (bluish green) and black colors, respectively. Moreover, the printing head 11 can reciprocate perpendicularly of the carried direction of the paper 2. On the basis of signals from the controller 20, therefore, the printing head 11 can discharge the color inks from the numerous discharge nozzles to the surface (the upper side in FIG. 1) of the carried paper 2, while reciprocating perpendicularly of the carried direction of the paper 2, to print a desired color image. On the printing head 11 may have a discharge nozzle capable of discharging the black ink only, to print a black-and-white image.

Here, the ink jet printing unit 6 prints the paper 2 by injecting dots of liquid ink from the nozzle or nozzles, and may adopt any of the piezoelectric jet type, the thermal jet type and another type.

On the other hand, the adsorption fan 12 is arranged to confront the printing head 11 across the conveyor route of the paper 2, and adsorbs the paper 2 on the carriage 13 through the (not-shown) holes formed in the carriage 13. Therefore, the paper 2 confronting the printing head 11 is conveyed in close contact with the carriage 13 while being sucked by the adsorption fan 12 arranged on the back side (or on the lower side in FIG. 1) of the paper 2, so that it holds a constant spacing from the printing head 11. Therefore, there is suppressed the printing trouble which might otherwise be caused, when the paper 2 is curled, by the change in the spacing from the printing head 11 as a portion of the paper 2 leaves the carriage 13 largely.

The pressure roller unit 7 clamps the paper 2 being conveyed between the ink jet printing unit 6 and the cutting unit 8. Here, the pressure roller unit 7 is arranged between the ink jet printing unit 6 and the cutting unit 8 so that the paper 2 can be properly printed by the ink jet printing unit 6 and cut by the cutting unit 8.

This cutting unit 8 is provided with a moving blade 8*a* arranged on the same side as that of the printing head 11 with respect to the paper 2, and a stationary blade 8*b* arranged to confront the moving blade 8*a* across the paper 2. Both the moving blade 8*a* and the stationary blade 8*b* are rectangular blades having slightly larger widths than that of the paper 2. The moving blade 8*a* can be brought toward and away from the stationary blade 8*b* by a motor 27 controlled by the controller 20, so that it can coact with the stationary blade 8*b* to cut along the width direction the printed paper 2 conveyed on the conveyor route from the upstream side. By this cutting, the printed paper 2 is divided into a predetermined length.

The discharge roller unit 9 is composed of a pair of drive rollers, which are driven by a motor 26 controlled by the controller 20, and conveys and discharges the printed paper 2 cut by the cutting unit 8, from a discharge port 30*a*.

The ink feed unit 15 is provided with an ink reservoir unit 16 and an air feed unit 17. The ink reservoir unit 16 reserves the color inks of yellow, magenta, cyan and black colors discharged from the printing head 11. Here, the ink reservoir unit 16 includes a plurality of ink cartridges 50 (as referred to FIG. 2) corresponding to the individual color inks. The detailed construction of the ink cartridges will be described hereinafter.

Moreover, the printing head 11 and the ink reservoir unit 16 are connected through a plurality of conduits 19. Specifically, the discharge nozzles contained in the printing head 11 and corresponding to the color inks of the individual colors and the ink cartridges 50 confining the color inks of the individual colors are individually connected through the conduits 19. Therefore, the printing head 11 can discharge the color inks, as fed from the ink cartridges 50, to the paper 2.

Here in this embodiment, a plurality of reservoirs 18 corresponding to the individual color inks are arranged between the printing head 11 and the ink reservoir unit 16. Therefore, the inks discharged from the ink reservoir unit 16 are once stored in fact in the reservoirs 18 and are then suitably fed to the printing head 11. Here, the reservoirs 18 are arranged at a higher positions than the printing head 11 so that the inks reserved in the reservoirs 18 are fed to the printing head 11 by the head difference.

The air feed unit 17 feeds the compressed air to the individual ink cartridges 50 contained in the ink reservoir unit 16. Specifically, the air is fed from the air feed unit 17 to the ink cartridges 50 so that the inks contained in the ink cartridges 50 can be fed to the reservoirs 18.

On the other hand, the controller 20 subjects the image signals, as fed from the not-shown interface, to a predetermined processing, and feeds the ink jet printing unit 6 with the printing signals containing the image data corresponding to an image to be printed. Moreover, the controller 20 controls the conveying timing of the paper 2 by the conveyor roller unit 5 and the discharge roller unit 9, the moving timing of the printing head 11 or the discharge timing of the inks from the printing head 11, the cutting timing of the paper 2 by the cutting unit 8, and so on. Still moreover, the controller 20 controls the amounts of air to be fed from the air feed unit 17 to the individual ink cartridges 50, thereby to adjusts the amounts of inks to be discharged from the ink cartridges 50.

Figure 2:
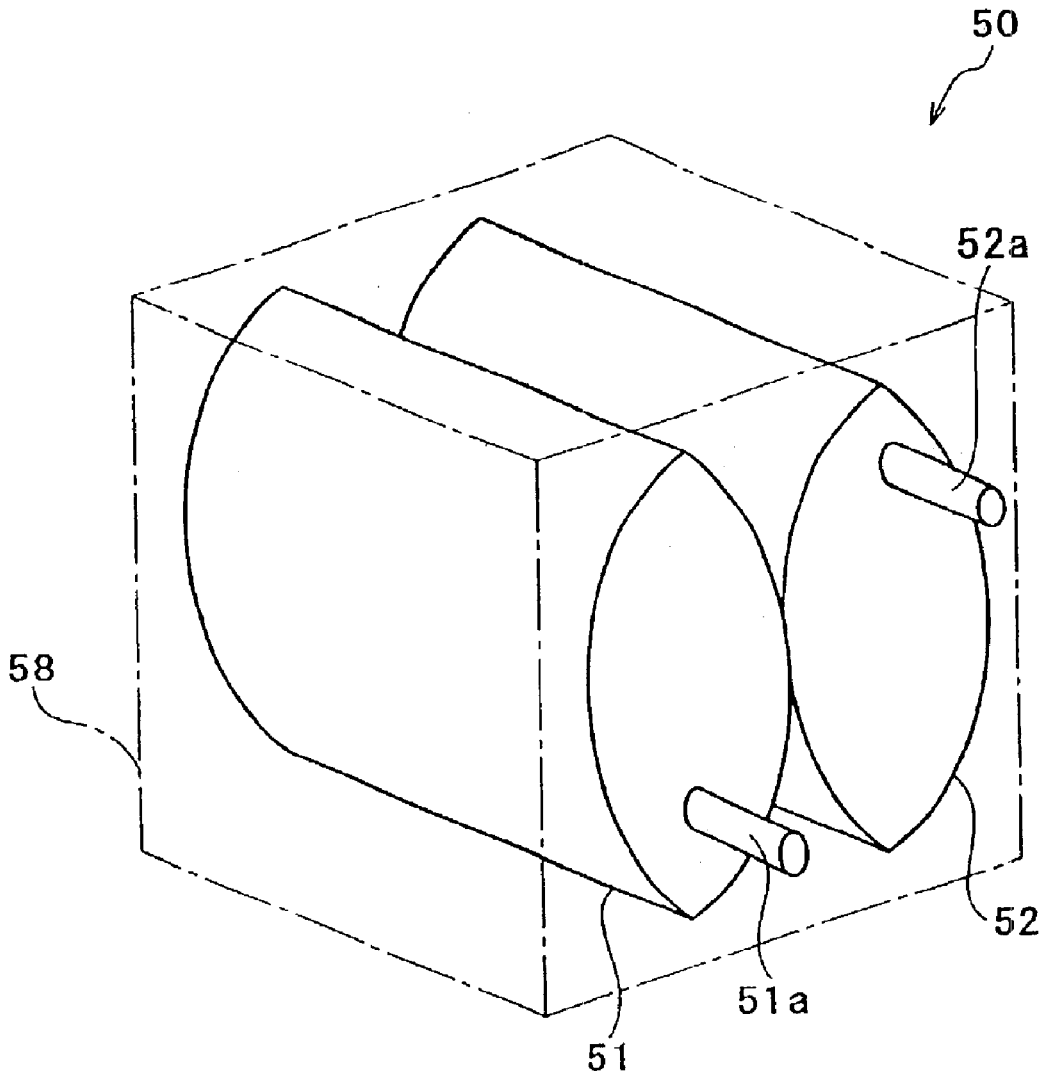
FIG. 2 is a perspective view showing the schematic construction of an ink cartridge.
Figure 3:
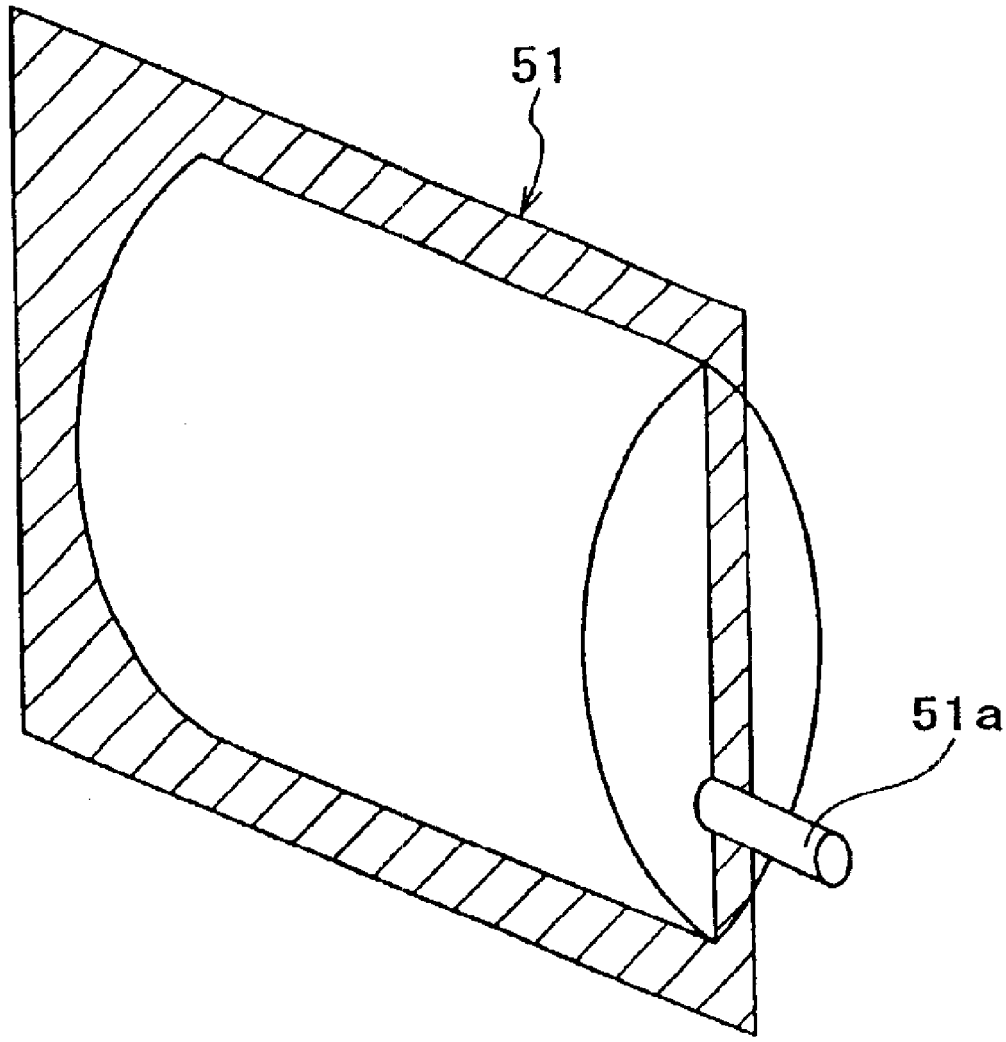
FIG. 3 is a perspective view showing the schematic construction of an ink pack.

Next, the detailed construction of the ink cartridges 50 will be described with reference to FIG. 2. FIG. 2 is a perspective view showing the schematic construction of an ink cartridge. FIG. 3 is a perspective view showing the schematic construction of an ink pack.

As shown in FIG. 2, the ink cartridge 50 is in a case 58 provided with an ink pack or bag 51 and an air injection pack or bag 52. The ink pack 51 is made of an air-impermeable material such as vinyl so that it forms a generally cylindrical region, as shown in FIG. 3, when it encloses an ink. Moreover, the ink pack 51 is provided at its one end portion with a pipe 51*a* communicating with the region formed therein. Therefore, the ink pack 51 can bulge gradually as the ink is confined in the internal region, and can contract gradually as the ink is discharged from the internal region to the outside. In short, the ink pack 51 has its volume increased or decreased as the ink is introduced or discharged. Here, the ink pack 51 is closed at its periphery (as hatched in FIG. 3) so that its internal region has a gas-tightness (or is sealed up) excepting the through hole of the pipe 51*a*.

Like the ink pack 51, moreover, the air injection pack 52 is made of an air-impermeable material such as vinyl so that it forms a generally cylindrical region when it encloses the air. Here, the structure of the air injection pack 52 is identical to that of the ink pack 51 so that its detailed description will be omitted. In other words, in this embodiment, both the ink pack 51 and the air injection pack 52 are formed in column shapes, i.e., in substantially identical shapes.

As shown in FIG. 2, moreover, the ink pack 51 and the air injection pack 52 are so arranged adjacent to each other in the case 58 that their individual side faces having the pipes 51*a* and 52*a* are parallel to the vertical direction. The ink pack 51 and the air injection pack 52 are further so arranged adjacent to each other that their individual axial centers are generally horizontal and parallel to each other (while their one-side faces confronting each other). With this arrangement, the ink pack 51 and the air injection pack 52 partially contact with each other at their individual one-side faces (or at their circumferential portions). Here in this embodiment, the ink pack 51 is so housed in the case 58 that the pipe 51*a* is arranged near the lower end portion of the ink pack 51, but the air injection pack 52 is so housed that its pipe 52*a* is arranged near the upper end portion. In short, the air injection pack 52 and the ink pack 51 having the substantially identical shapes are arranged in a vertically inverse relation to each other.

Here, FIG. 2, as described later, shows the state in which the ink had been discharged in a predetermined quantity from the unused ink pack 51 after the air was injected in a predetermined quantity into the air injection pack 52. In case the unused ink pack 51 is housed in the case 58, therefore, the volume of the ink pack 51 is larger than that of the state shown in FIG. 2, but the volume of the air injection pack 52 is smaller than that of the state shown in FIG. 2 (as referred to FIG. 4A). In case the air injection pack 52 having little air injected is to be arranged adjacent to the unused ink pack 51, therefore, it is preferable that the arrangement considers the state (e.g., the shape), in which the volume of the air injection pack 52 is increased by injecting the air.

Figure 4A:
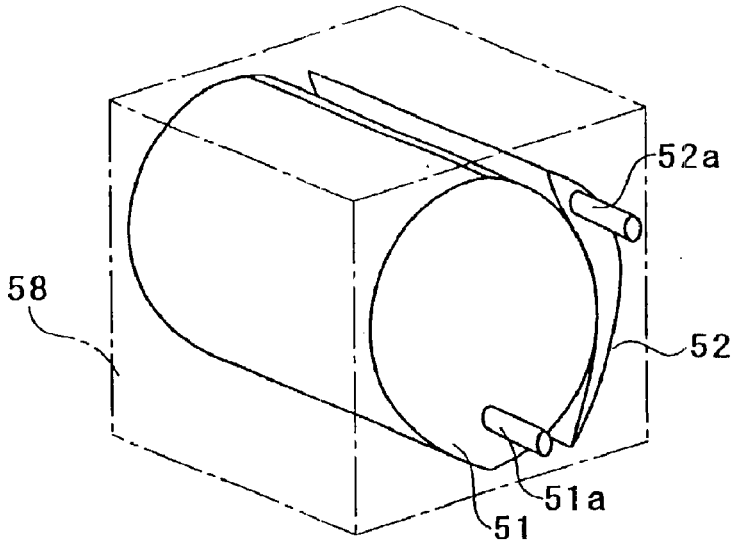
FIGS. 4A, 4B and 4C presents perspective views for explaining the actions of the ink cartridge.
Figure 4B:
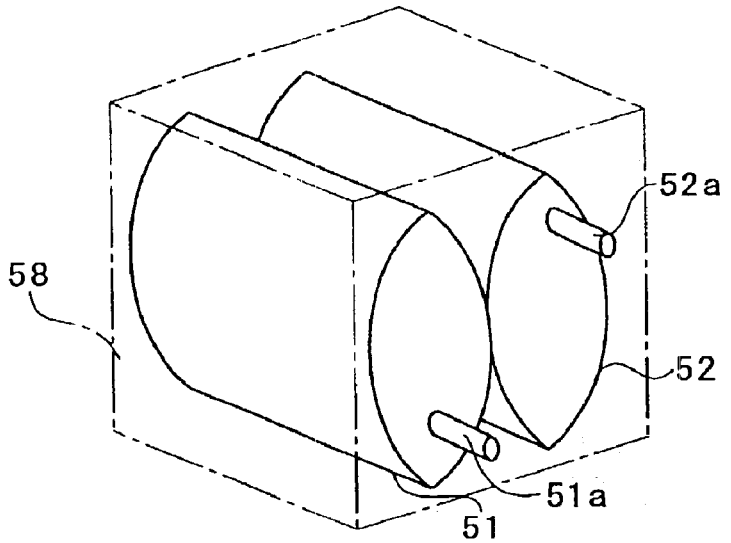
Figure 4C:
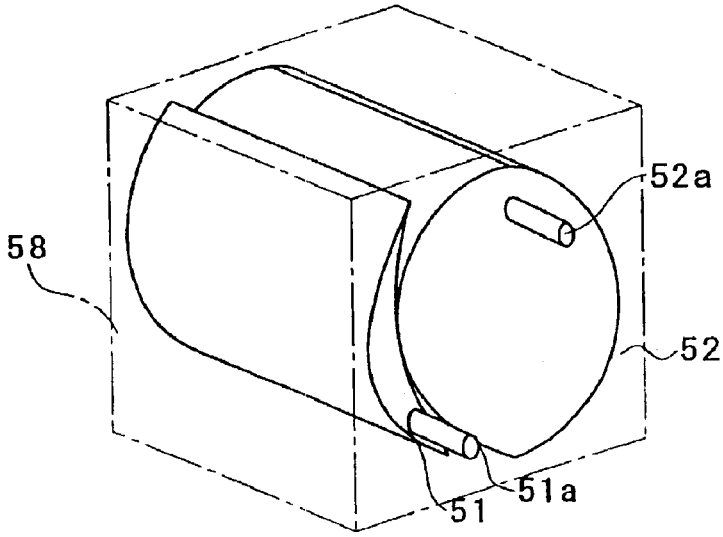

Next, the actions of the ink cartridge 50 thus constructed according to this embodiment will be described with reference to FIGS. 4A, 4B and 4C. FIGS. 4A, 4B and 4C presents perspective views for explaining the actions of the ink cartridge.

As the printing action is started in the ink jet printer 1, the conveyor roller unit 5 of paired drive rollers is driven at first by the motor 25 so that the paper 2 is sequentially let off the wound portion 2*a* and conveyed over the carriage 13. When the paper 2 arrives at a portion confronting the printing head 11, this printing head 11 discharges the ink to the paper 2 while moving perpendicularly of the conveying direction of the paper 2, thereby to start the print of an image.

The color inks, as discharged from the discharge nozzles of the printing head 11, are fed from the ink feed unit 15, as has been described hereinbefore. Specifically, the color inks of the individual colors are fed to the discharge nozzles of the printing head 11, after they were individually discharged from the ink cartridges 50 contained in the ink reservoir unit 16 and were once reserved in the reservoir 18.

Here in case the unused ink pack 51 is housed in the case 58, as shown in FIG. 4A, it encloses much ink and has a large volume, but the air injection pack 52 has little air injected so that it has a relatively small volume.

In order to feed the ink from the ink cartridge 50 to the printing head 11, moreover, the air is injected by the air feed unit 17 into the air injection pack 52 from the pipe 52*a* of the same. As shown in FIG. 4B, the volume of the ink pack 51 is then gradually decreased as the volume of the air injection pack 52 is gradually increased. At this time, the ink is discharged in a quantity corresponding to the decrease in the volume of the ink pack 51, from the pipe 51*a* of the ink pack 51 to the reservoir 18. By controlling the air feed unit 17 by the controller 20, therefore, the ink in the quantity necessary for printing the image can be fed from the ink cartridge 50 to the reservoir 18.

In the later case where the ink for printing the image is successively required, the air is further injected by the air feed unit 17 into the air injection pack 52 through the pipe 52*a*. Then, the volume of the ink pack 51 is further decreased, as shown in FIG. 4C, as the volume of the air injection pack 52 is further increased. At this time, like before, the ink in the quantity corresponding to the decrease in the volume of the ink pack 51 is discharged from the pipe 51*a* of the ink pack 51 to the reservoir 18. Thus, the ink confined in the ink pack 51 can be substantially wholly discharged from the pipe 51*a* of the ink pack 51 and fed to the reservoir 18.

Here, the air feed unit 17 is connected individually separately to the ink cartridges 50 corresponding to the color inks, as has been described hereinbefore. Therefore, the air quantities to be fed from the air feed unit 17 to the air injection packs 52 contained in the individual ink cartridges 50 are adjusted separately of one another. Thus, it is possible to feed the air in a necessary quantity exclusively to such an air injection pack 52 of the ink cartridge 50 as corresponds to the color ink in the color used for printing the image.

According to the ink jet printer 1 containing the ink cartridge 50 according to this embodiment, as has been described hereinbefore, the air injection pack 52 is arranged adjacent to the ink pack 51 enclosing the ink, so that the volume of the ink pack 51 can be decreased to discharge the ink from the ink pack 51 by feeding the air to the inside of the air injection pack 52 thereby to increase the volume of the same. Moreover, the ink discharged from the ink pack 51 is fed to the printing head 11 so that it is discharged to the paper 2. Therefore, the ink cartridge to be used needs not always be provided with the case having the gas-tightness for housing the ink pack 51. Therefore, the steps of assembling the ink cartridge 50 can be prevented from becoming complex, and the step of testing the gas-tightness of said case need not be added, so that the cost for manufacturing the ink cartridge 50 can be lowered. As a result, the steps of manufacturing the ink jet printer 1 can be simplified, and the manufacturing cost for the same can be lowered. Moreover, the used ink pack 51 can be easily replaced by an unused one so that the ink cartridge 50 can be easily recycled.

Moreover, the ink pack 51 and the air injection pack 52 are housed in the case 58 so that they can be prevented from being broken while they are being carried. Still moreover, the case 58 needs not have the gas-tightness so that its manufacturing steps can be simplified.

Moreover, both the ink pack 51 and the air injection pack 52 are given the substantially identical column shapes and are so arranged adjacent to each other that their one-side faces confront each other, so that the ink confined in the ink pack 51 is efficiently discharged. Still moreover, the member of the same shape can be utilized for either the in pack 51 or the ink injection pack 52 so that the ink pack 51 and the air injection pack 52 need not be manufactured separately of each other.

Figure 5:
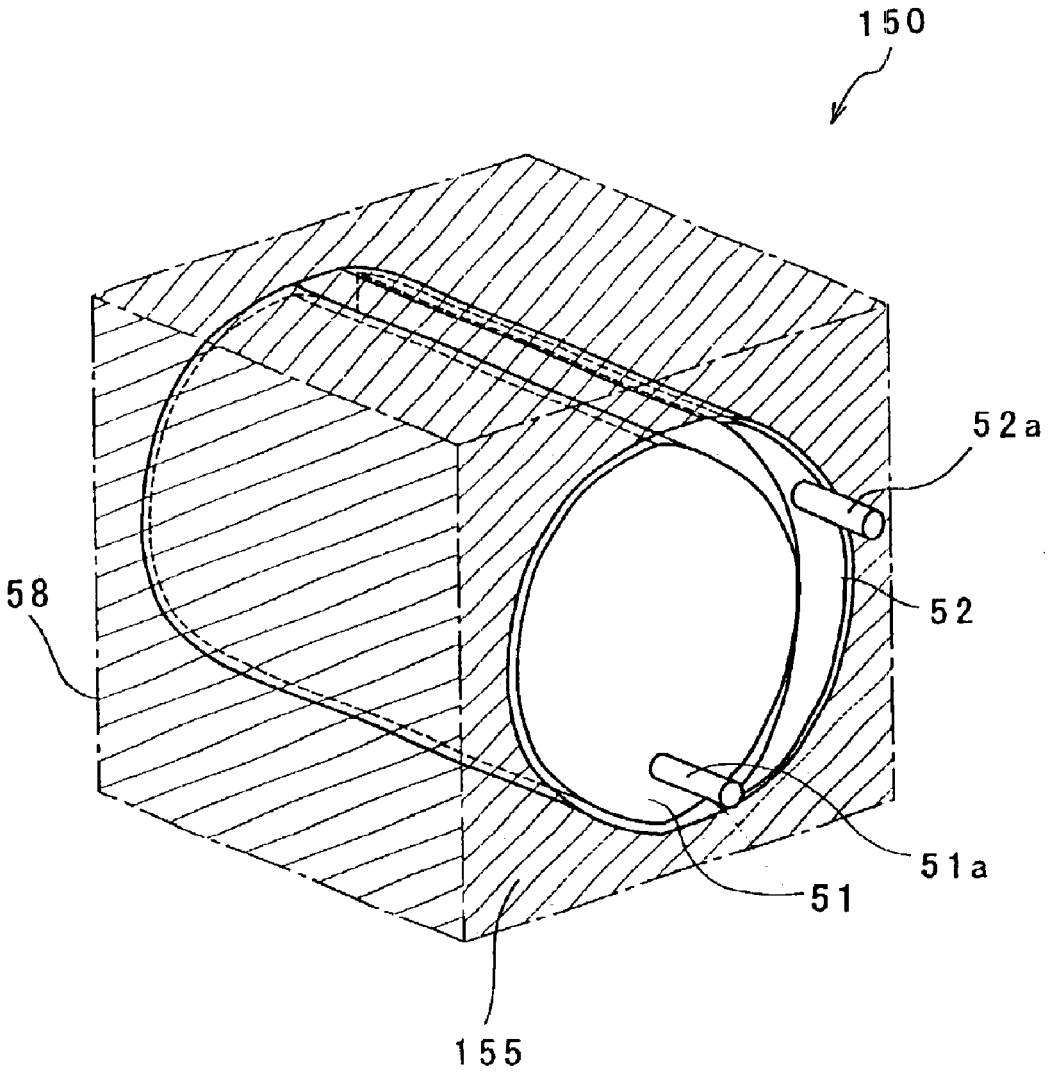
FIG. 5 is a perspective view showing a schematic construction of the ink cartridge according to the second embodiment.

Next, an ink cartridge according to a second embodiment of the invention will be described with reference to the accompanying drawing. FIG. 5 is a perspective view showing a schematic construction of the ink cartridge according to the second embodiment. With reference to the constructions similar to those of the first embodiment, detailed description will be omitted by designating them by the common reference numerals.

An ink cartridge 150, as shown in FIG. 5, is provided in the case 58 with a regulating member 155 (as hatched in FIG. 5), which is made of foamed styrol, for example, to fill up the clearance between the inner wall faces of the case 58, and the ink pack 51 and the air injection pack 52. Therefore, the fluctuation of the volume of the ink pack 51 is regulated by the regulating member 155. As a result, the ink confined in the ink pack 51 is efficiently discharged.

Figure 6:
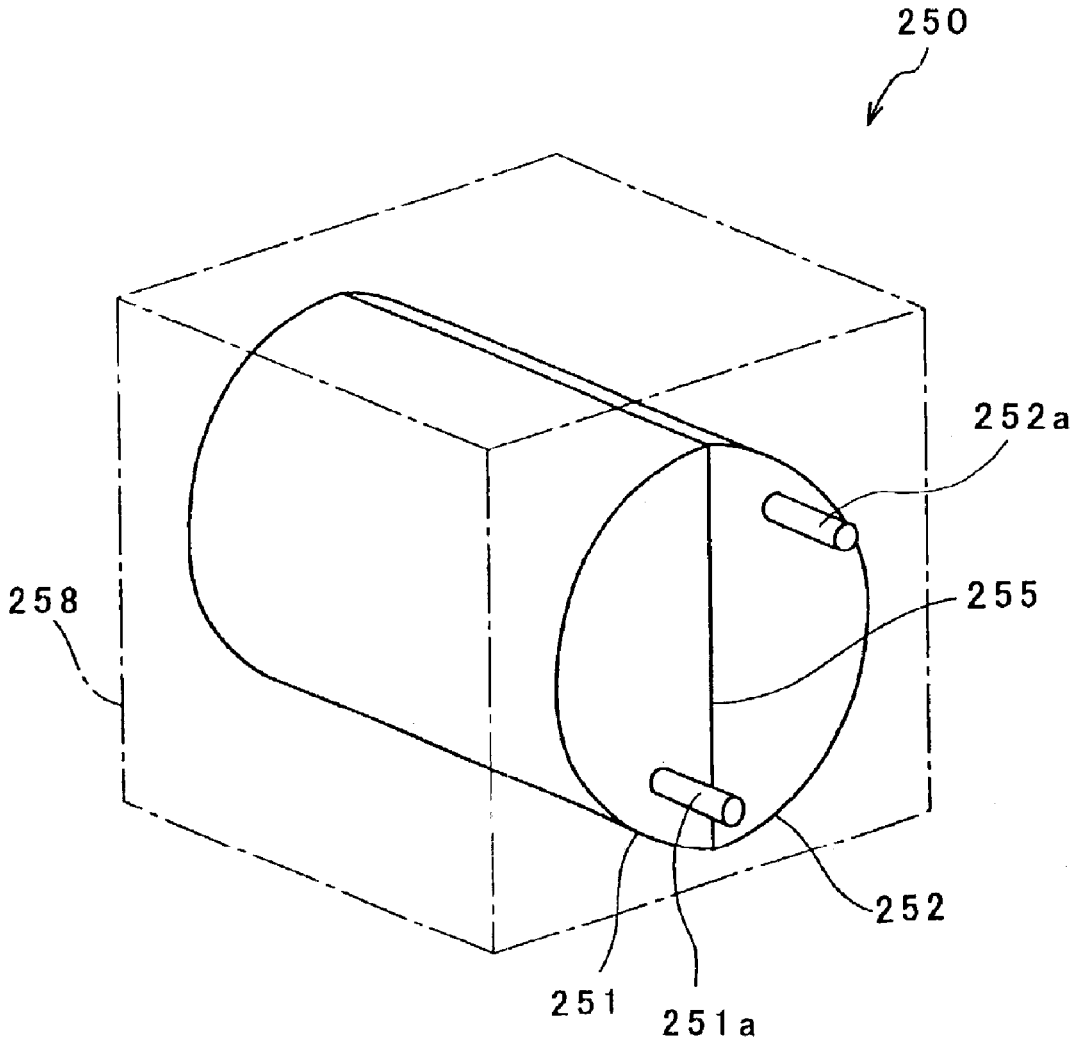
FIG. 6 is a perspective view showing a schematic construction of the ink cartridge according to the third embodiment.

Next, an ink cartridge according to a third embodiment of the invention will be described with reference to the accompanying drawing. FIG. 6 is a perspective view showing a schematic construction of the ink cartridge according to the third embodiment.

In an ink cartridge 250 shown in FIG. 6, an ink pack 251 and an air injection pack 252 are made integral and housed in a case 258. Specifically, both the ink pack 251 and the air injection pack 252 are formed into column shapes and are so arranged adjacent to each other that their individual axial centers are generally horizontal and parallel to each other while sharing a boundary surface 255. Moreover, the ink pack 251 and the air injection pack 252 are provided at their one-end portions with pipes 251*a* and 252*a* communicating the regions formed therein. Thus, the ink confined in the ink pack 251 is efficiently discharged. Moreover, it is possible to lower the cost for manufacturing the ink cartridge 250 (especially the cost for the material).

Figure 7:
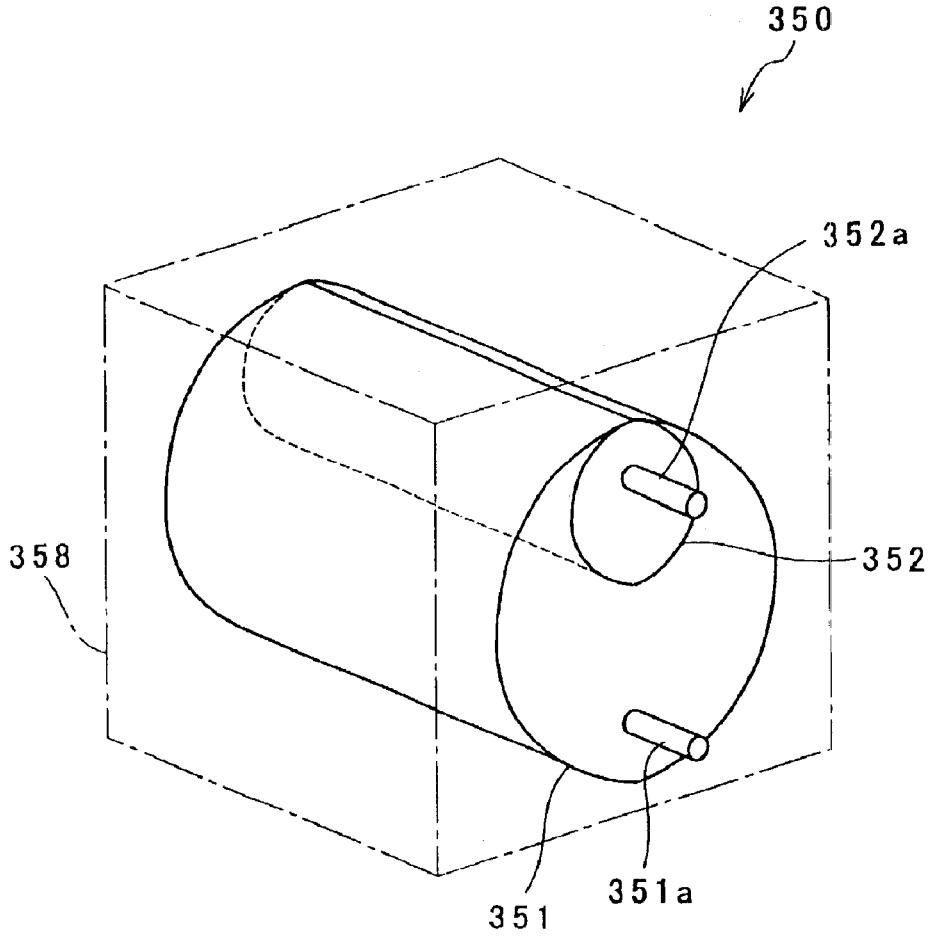
FIG. 7 is a perspective view showing a schematic construction of the ink cartridge according to the fourth embodiment.

Next, an ink cartridge according to a fourth embodiment of the invention will be described with reference to the accompanying drawing. FIG. 7 is a perspective view showing a schematic construction of the ink cartridge according to the fourth embodiment.

In an ink cartridge 350 shown in FIG. 7, an air injection pack 352 is confined in an ink pack 351 in a case 358. Specifically, the air injection pack 352 having a column shape is so arranged in its entirety as is enclosed by the ink pack 351 having a column shape, so that the ink pack 351 and the air injection pack 352 are formed to have a dual structure. Here, the ink pack 351 and the air injection pack 352 are provided at their one-end portions with pipes 351*a* and 352*a* communicating with the regions formed therein. In this case, too, as the air is fed from the pipe 352*a* so that the volume of the air injection pack 352 is gradually increased, the volume of the ink pack 351 is gradually decreased so that the ink in the ink pack 351 is discharged from the pipe 351*a*. Thus, the ink confined in the ink pack 251 is efficiently discharged.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

For examples, the foregoing first to fourth embodiments have been described on the ink cartridge in which the ink pack and the air injection pack made of the separate members but respectively having the substantially identical shapes are arranged adjacent to each other, the ink cartridge in which the ink pack and the air injection pack are made integral with each other, or the ink cartridge in which the air injection pack is housed in the ink pack. However, the constructions of the ink pack and the air injection pack should not be limited to those but can be arbitrarily changed if the ink cartridge is provided with an ink pack and an air injection pack, which is arranged adjacent to the ink pack and can decrease the volume of the ink pack as its volume is increased with the air fed thereinto.

Moreover, the first to fourth embodiments have been described on the case in which the ink pack and the air injection pack are housed in the case, but the ink pack and the air injection pack need not always be housed in the case. In the second embodiment, therefore, not the case but only the regulating member may be disposed around the ink pack and the air injection pack. In this case, too, the ink pack and the air injection pack can be suppressed from being broken, for example, while being carried.

Still moreover, the first to fourth embodiments have been described on the case in which both the ink pack and the air injection pack have the column shapes. However, the shapes of the ink pack and the air injection pack (i.e., the shapes of their internal regions) can be arbitrarily changed.

On the other hand, the second embodiment has been described on the case in which the regulating member is disposed around the ink pack and the air injection pack. However, the regulating member may be disposed around at least the ink pack, and its construction can be arbitrarily changed within such a range as can regulate the fluctuation of the volume of the ink pack. Therefore, the construction may also be exemplified by ribs formed around the ink pack.

On the other hand, the third embodiment has been described on the case in which the boundary surface between the ink pack and the air injection pack is wholly shared. However, at least a portion of the boundary surface may be shared between the ink pack and the air injection pack.

On the other hand, the first to fourth embodiments have been described on the case in which the air injection pack to be used as a pressure member is fed with the air acting as a pressure medium. However, this pressure medium may be exemplified by a gas other than air or by a liquid.

On the other hand, the first embodiment has been described on the ink cartridge contained in the ink jet printer. However, the supply liquid cartridge maybe a cartridge, which is attached to an image forming apparatus other than the ink jet printer. Therefore, the supply liquid cartridge may be exemplified by a cartridge, which encloses a supply liquid other than the ink, such as a developing liquid cartridge contained in a photograph processing apparatus and enclosing a developing liquid.

What is claimed is:

1. A supply liquid cartridge comprising:

an enclosing bag enclosing a supply liquid; and a pressure bag arranged adjacent to said enclosing bag and enabled to decrease the volume of said enclosing bag by directly contacting and pushing said enclosing bag, as the volume of said pressure bag is increased by a pressure medium fed to the inside of said pressure bag.

2. A supply liquid cartridge according to claim 1, wherein at least a portion of said enclosing bag is shared with said pressure bag.

3. A supply liquid cartridge according to claim 1, further comprising:

a case for housing said enclosing bag and said pressure bag.

4. A supply liquid cartridge according to claim 1, further comprising:

a regulating member disposed around said enclosing bag for regulating the fluctuation shape in the volume of said enclosing bag.

5. A supply liquid cartridge according to claim 1, wherein said enclosing bag and said pressure bag have substantially identical shapes.

6. A supply liquid cartridge according to claim 1, wherein both said enclosing bag and said pressure bag have column shapes and are so arranged adjacent to each other that their respective outer surfaces face each other.

7. A supply liquid cartridge according to claim 1, wherein said pressure bag is housed in said enclosing bag.

8. A supply liquid cartridge according to claim 1, wherein said pressure bag is disposed outside of said enclosing bag.

9. An image forming apparatus comprising:

a supply liquid cartridge comprising an enclosing bag enclosing a supply liquid; a pressure bag arranged adjacent to said enclosing bag and enabled to decrease the volume of said enclosing bag by directly contacting and pushing said enclosing bag, as the volume of said pressure bag is increased by a pressure medium fed to the inside of said pressure bag;

a pressure medium feed device capable of feeding the pressure medium to the inside of said pressure bag;

a control device for controlling the quantity of the pressure medium to be fed from said pressure medium feed device to the inside of said pressure bag; and a discharge unit for discharging the supply liquid, as discharged from said enclosing bag, to a recording medium.

* * * * *